US006428849B1

(12) United States Patent
Tsai et al.

(10) Patent No.: US 6,428,849 B1
(45) Date of Patent: Aug. 6, 2002

(54) METHOD FOR THE CO-DEPOSITION OF SILICON AND NITROGEN ON STAINLESS STEEL SURFACE

(75) Inventors: Wen-Ta Tsai, Tainan; Hung-Wen Hsu, Changhua Hsien, both of (TW)

(73) Assignee: National Science Council, Taipei (TW)

( * ) Notice: Subject to any disclaimer, the term of this patent is extended or adjusted under 35 U.S.C. 154(b) by 212 days.

(21) Appl. No.: 09/588,216

(22) Filed: Jun. 6, 2000

(30) Foreign Application Priority Data

Aug. 30, 1999 (TW) ..... 88114820 A

(51) Int. Cl.[7] ..... C23C 16/28

(52) U.S. Cl. ..... 427/255.17; 427/255.27; 427/299; 427/309; 427/327; 148/217; 148/230; 148/279

(58) Field of Search ..... 148/279, 217, 148/230; 427/255.17, 255.27, 299, 309, 327

(56) References Cited

U.S. PATENT DOCUMENTS 5,421,914 A * 6/1995 Park ..... 148/217

* cited by examiner

*Primary Examiner*—Timothy Meeks
(74) *Attorney, Agent, or Firm*—Fei-Fei Chao; Venable, Baetjer, Howard & Civiletti, LLP

(57) ABSTRACT

The invention discloses a method for producing a nitrogen-silicon containing stainless steel layer on a metal. The method includes a pack cementation process involving the use of silicon nitride, silica and sodium fluoride as the source materials.

14 Claims, 6 Drawing Sheets

METHOD FOR THE CO-DEPOSITION OF SILICON AND NITROGEN ON STAINLESS STEEL SURFACE

BACKGROUND OF THE INVENTION

1. Field of the Invention

The present invention relates to a method for the co-deposition of silicon and nitrogen on a stainless steel surface, and more particularly to a method of deposition using silicon nitride powder as the source material by a pack cementation process.

2. Description of the Related Arts

It is known that the addition of proper amounts of silicon to stainless steel not only increases the resistance to oxidation at high temperature, but also elevates the hardness. Further, if the stainless steel contains more nitrogen, its resistance to corrosion, like pitting, will be improved as well. However, when using conventional metallurgical techniques to add silicon or nitrogen to stainless steel, such as smelting and casting followed by cold processing, the resulting casting will become brittle due to the high silicon content. Therefore, it is advantageous to modify the surface of a stainless steel work piece instead.

Conventional surface deposition techniques for alloying include pack cementation and laser scan. The pack cementation technique usually employs elemental silicon as source material. For example, U.S. Pat. No. 5,589,220 discloses a method for depositing silicon and chromium onto the surface of a metal using silicon and chromium powders as source materials and an activator. U.S. Pat. No. 5,492,727 also uses silicon and chromium powders as source materials, however, it uses at least two activators for depositing. Then, the surface alloy layer is formed in a diffusion manner. U.S. Pat. No. 5,364,659 uses chromium-silicon master alloy as source material, and uses a mixture of activators to produce a metal surface with a diffusion layer containing high silicon and chromium. U.S. Pat. No. 4,500,364 uses elemental aluminum and silicon or Al-Si eutectic or Al-Si hypereutectic as source material to produce the surface of a diffusion layer containing aluminum and silicon. USRE 029212 discloses a method for producing an aluminum cladded material. All the patents described above employ the pack cementation technique. The differences among them are the different source materials and activators used, and different contents in the resulting surface diffusion layer. None of the patents, however, discloses using silicon nitride as source material. Silicon nitride may be used as source material when using the laser scan technique for alloying. However, the device used in this method is expensive and the control of atmosphere in the process is also complex. Further, this method is not suitable for an article with complex shape. Thus, the applications of laser scan technique for alloying are limited. There are presently no references disclosing the depositing of nitrogen using the pack cementation technique.

SUMMARY OF THE INVENTION

It is therefore a primary object of the present invention to provide a method for co-depositing silicon and nitrogen coatings on a stainless steel surface, the method comprising the steps of: (a) cleaning the surface of said stainless steel by mechanical and/or physical and chemical means; (b) placing the stainless steel in a cementation pack including at least a mixture of sodium fluoride, silica and silicon nitride powder; and (c) heating said stainless steel and cementation pack in an inert atmosphere, wherein the silicon nitride powder is thereby decomposed into elemental silicon and nitrogen and diffusely coated onto the surface of said stainless steel to form a nitrogen-containing high silicon stainless steel.

Another object of the present invention is to provide a metal having a stainless steel surface on which silicon and nitrogen are deposited, wherein the surface is comprised of 1% to 15% silicon content and 0.1% to 0.6% nitrogen content, and the metal is produced by the method described above.

BRIEF DESCRIPTION OF THE FIGURE

The present invention will be more fully understood and further advantages will become apparent when reference is made to the following description of the invention and the accompanying drawings in which.

DETAILED DESCRIPTION OF THE INVENTION

The method according to the present invention can be briefly described as follows. First, the surface of the steel specimen is cleaned by mechanical and/or physical and chemical means. Then the surface of the stainless steel is placed in a cementation pack which contains a mixture of chemical source material powders. Finally, the stainless steel and the cementation pack is heated in an inert atmosphere.

The main object of the cleaning procedure is to remove impurities or oxides on the surface, thereby preventing impurities from contaminating the surface alloy layer. The cleaning procedure includes mechanical and/or physical and chemical means, wherein the mechanical means comprises the step of grinding said surface using, for example, silicon carbonate sandpaper, and the physical and chemical means comprises the step of ultrasonicating said surface in acetone solution.

The stainless steel that can be used in the present invention includes austenite, ferrite, martensite and dual-phase stainless steel. According to the present invention, the cementation pack includes at least a mixture of sodium fluoride, silica and silicon nitride powder, wherein the amount of silicon nitride ranges from 5 wt % to 80 wt %, the amount of sodium fluoride ranges from 5 wt % to 15 wt % and the amount of silica ranges from 5 wt % to 80 wt % based on the total weight of the mixture of powders in the pack.

After cleaning the surface of the stainless steel and placing it in a the cementation pack, the stainless steel and cementation pack are heated in an inert atmosphere. The inert atmosphere that can be used in the present invention includes nitrogen, argon or a reducing atmosphere. The heating duration and temperature can range from 1 minute to 100 hours and from 700° C. to 1300° C., respectively.

The resulting surface obtained on the stainless steel is comprised of 1% to 15% silicon content and 0.1% to 0.6% nitrogen content, and the thickness of the resulting surface on the stainless steel is between 1 and 100 $\mu$m.

Without intending to limit it in any manner, the present invention will be further illustrated by the following examples.

EXAMPLE 1

Figure 1A:
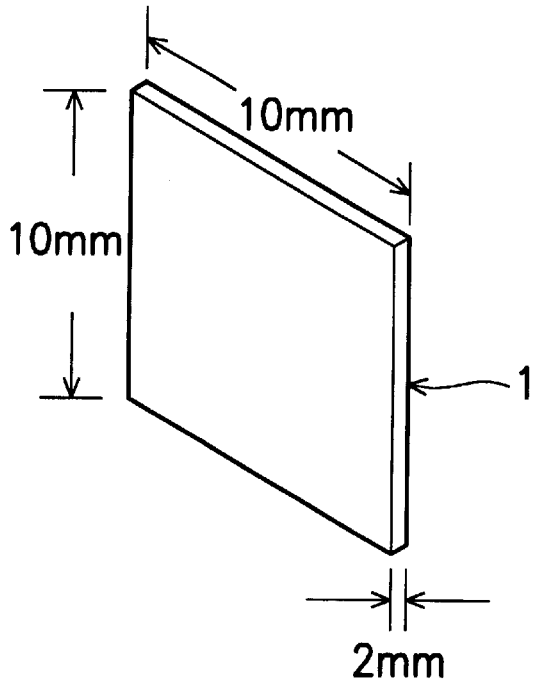
FIG. 1*a* is a diagram showing the steel specimen used in example 1.
Figure 1B:
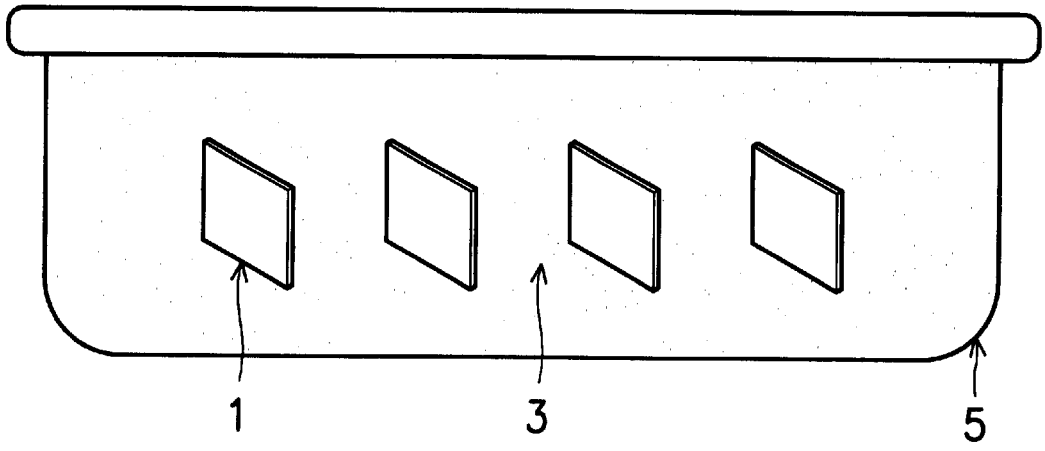
FIG. 1*b* is a diagram showing the relative location between the steel specimen and a cementation pack which contains a mixture of chemical source material powders.

AISI 310 stainless steel specimens as shown in FIG. 1*a* were used. The surface of the AISI 310 stainless steel specimen was ground using silicon carbonate sandpaper until the sandpaper #1000 was used. Then the specimen was cleaned in acetone solution using an ultrasonicator. Referring to FIG. 1*b*, the AISI 310 specimen was placed in a cementation pack containing 10 wt % of sodium fluoride, 10 wt % of silicon nitride and 80 wt % of silica. The total weight of chemical source material powders was 30 grams. The cementation pack containing the stainless steel was heated at 1000° C. for 10 hours in an oven using nitrogen atmosphere. The treating conditions are shown in Table 1, and the elemental silicon content in the surface of the resulting specimen is listed in Table 2.

COMPARATIVE EXAMPLE 1

All parameters were the same as in example 1 except that no inert atmosphere was used during the heating process. The treating conditions are shown in Table 1, and the elemental silicon content in the surface of the resulting specimen is listed in Table 2.

EXAMPLE 2

All parameters were the same as in example 1 except that the ratio of the chemical source material powders was changed to 5 wt % of sodium fluoride and 15 wt % of silicon nitride. The treating conditions are shown in Table 1, and the elemental silicon content in the surface of the resulting specimen is listed in Table 2.

EXAMPLE 3

All parameters were the same as in example 1 except that the ratio of the chemical source material powders was changed to 7 wt % of sodium fluoride and 78 wt % of silica. The treating conditions are shown in Table 1, and the elemental silicon content in the surface of the resulting specimen is listed in Table 2.

EXAMPLE 4

All parameters were the same as in example 1 except that the ratio of the chemical source material powders was changed to 30 wt % of silicon nitride and 63 wt % of silica. The treating conditions are shown in Table 1, and the elemental silicon content in the surface of the resulting specimen is listed in Table 2.

EXAMPLE 5

All parameters were the same as in example 1 except that the ratio of the chemical source material powders was changed to 10 wt % of sodium fluoride, 50 wt % of silicon nitride and 40 wt % of silica. The treating conditions are shown in Table 1, and the elemental silicon content in the surface of the resulting specimen is listed in Table 2.

EXAMPLE 6

All parameters were the same as in example 1 except that the heating temperature was elevated to 1200° C. The treating conditions are shown in Table 1, and the elemental silicon content in the surface of the resulting specimen is listed in Table 2.

TABLE 1

| Specimen | Ratio of Chemical Source Material Powders (30 g) | Inert Atmosphere | Heating Temp. (° C.) |
|---|---|---|---|
| Comparative example 1 | 10% NaF + 10% $Si_3N_4$ + 80% $SiO_2$ | — | 1000 |
| example 1 | 10% NaF + 10% $Si_3N_4$ + 80% $SiO_2$ | $N_2$ | 1000 |
| example 2 | 5% NaF + 15% $Si_3N_4$ + 80% $SiO_2$ | $N_2$ | 1000 |
| example 3 | 7% NaF + 15% $Si_3N_4$ + 78% $SiO_2$ | $N_2$ | 1000 |
| example 4 | 7% NaF + 30% $Si_3N_4$ + 63% $SiO_2$ | $N_2$ | 1000 |
| example 5 | 10% NaF + 50% $Si_3N_4$ + 40% $SiO_2$ | $N_2$ | 1000 |
| example 6 | 7% NaF + 15% $Si_3N_4$ + 78% $SiO_2$ | $N_2$ | 1200 |

TABLE 2

| | The elemental silicon content (wt %) in specimen surface | | | | | | | | | |
|---|---|---|---|---|---|---|---|---|---|---|
| | 1* | 2 | 4 | 6 | 8 | 10 | 20 | 30 | 40 | 50 |
| AISI 310 | 0.65 | — | — | — | — | — | — | — | — | — |
| Comp. Exp 1 | 0.67 | — | — | — | — | — | — | — | — | — |
| example 1 | 3.90 | 3.28 | 3.07 | 2.53 | 2.37 | 1.22 | 0.89 | 1.01 | 0.85 | 0.71 |
| example 2 | 2.97 | 2.57 | 2.15 | 1.76 | 2.02 | 1.28 | 0.96 | 0.76 | 0.70 | 0.68 |
| example 3 | 3.21 | 2.74 | 2.36 | 2.32 | 2.22 | 1.7 | 1.42 | 1.03 | 1.07 | 1.07 |
| example 4 | 3.31 | 2.81 | 2.47 | 2.47 | 2.36 | 1.97 | 1.72 | 1.45 | 0.75 | 0.77 |
| example 5 | 3.25 | 3.03 | 3.22 | 2.86 | 2.83 | 1.77 | 1.48 | 1.01 | 0.76 | 0.70 |
| example 6 | 4.00 | 3.90 | 3.24 | 3.2 | 3.3 | 3.32 | 3.11 | 2.76 | 2.81 | 2.64 |

Note
*the values listed in the first row indicate the depth from the surface in $\mu$m.

Figure 2:
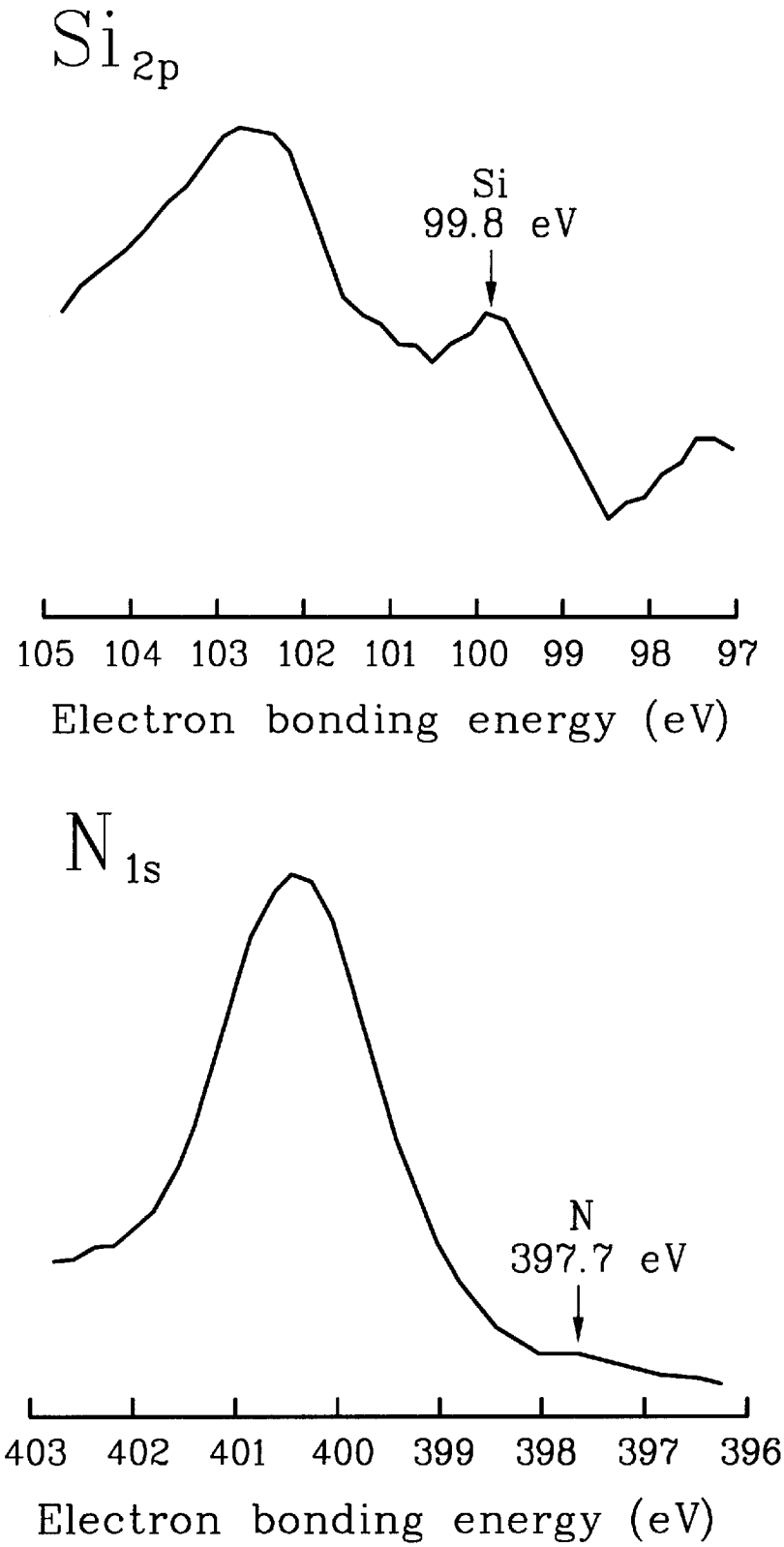
FIG. 2 shows the bond energy of silicon and nitrogen in the high silicon-containing stainless steel layer formed in example 2.

The bond energy of elemental silicon and nitrogen in the surface layer obtained from example 2 was analyzed by x-ray photoelectron spectroscopy (XPS). The result is shown in FIG. 2. The Si2PXPS spectrograph has a peak in 99.8 eV, demonstrating the presence of elemental silicon, whereas the N1SXPS spectrograph has a peak in 397.7 eV, demonstrating the presence of elemental nitrogen. This indicates the formation of a silicon and nitrogen-containing layer on the surface of the stainless steel specimen.

Figure 3:
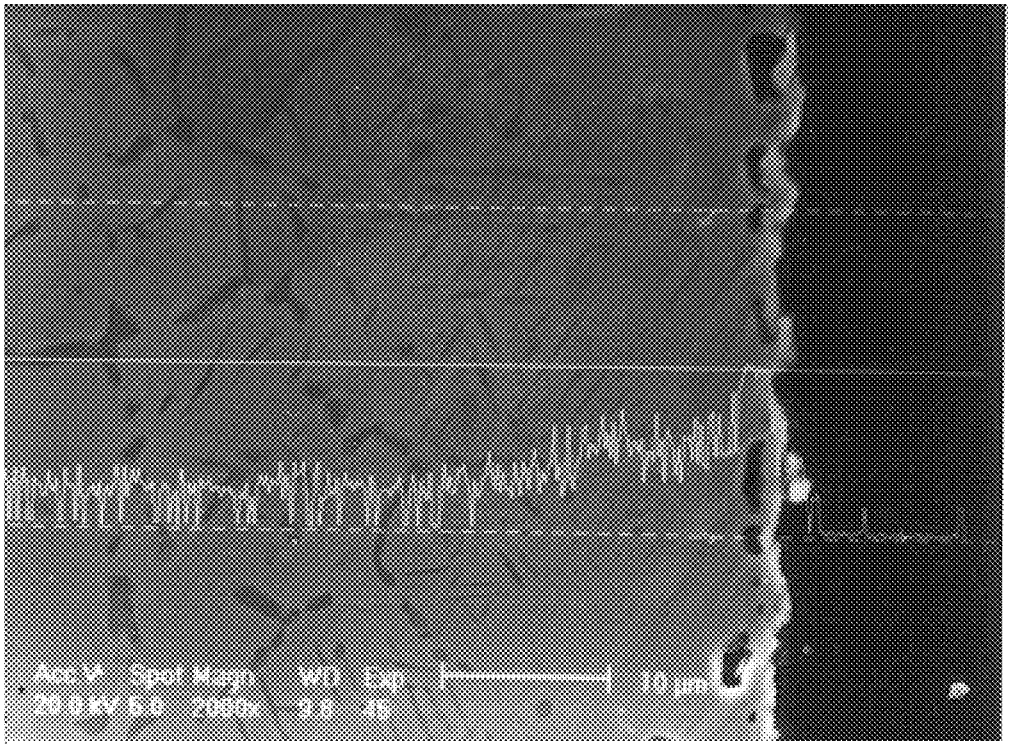
FIG. 3 is a scanning plot showing silicon content in the cross section of the steel obtained from example 4.
Figure 4:
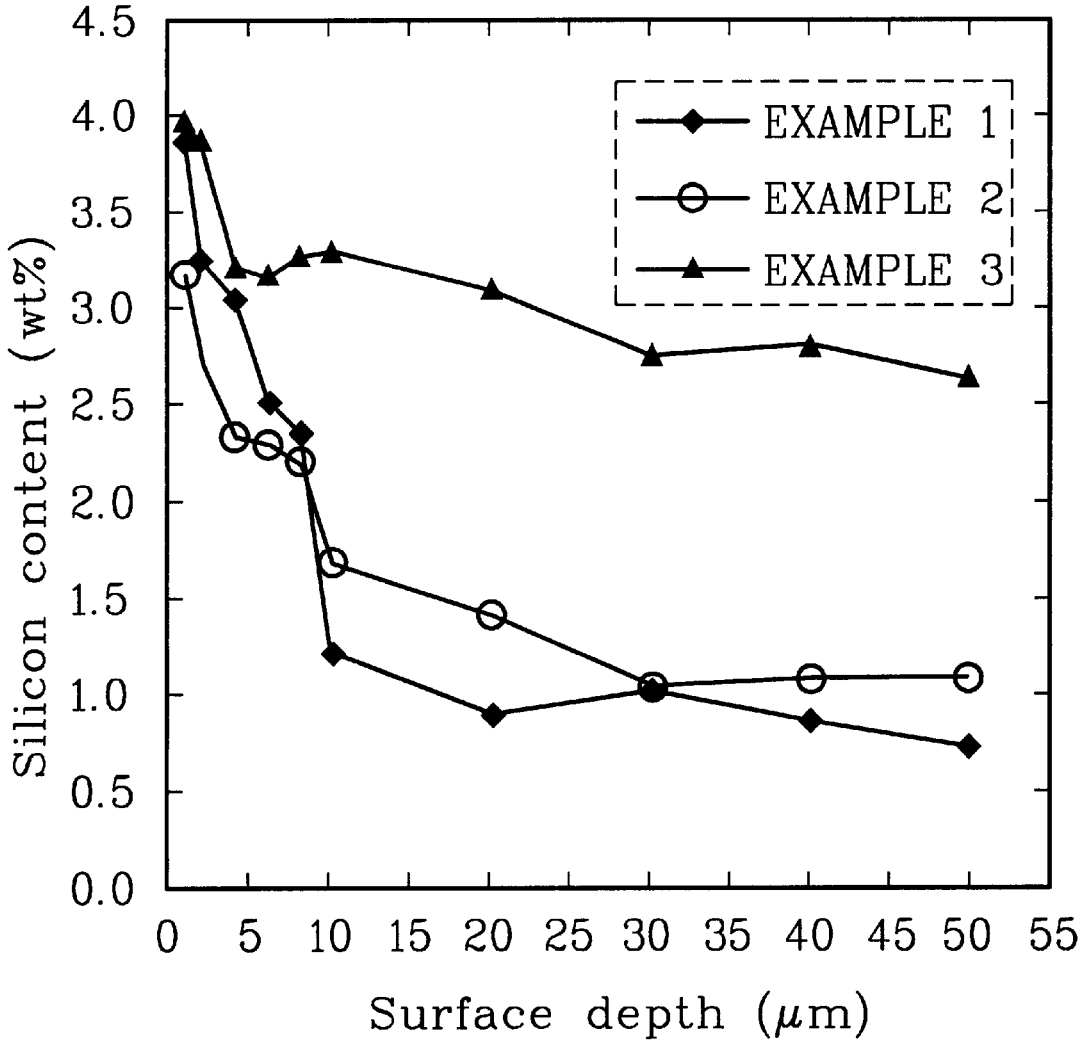
FIG. 4 shows the relation of silicon content and depth of the surface layer treated in examples 1, 3 and 6.
Figure 6:
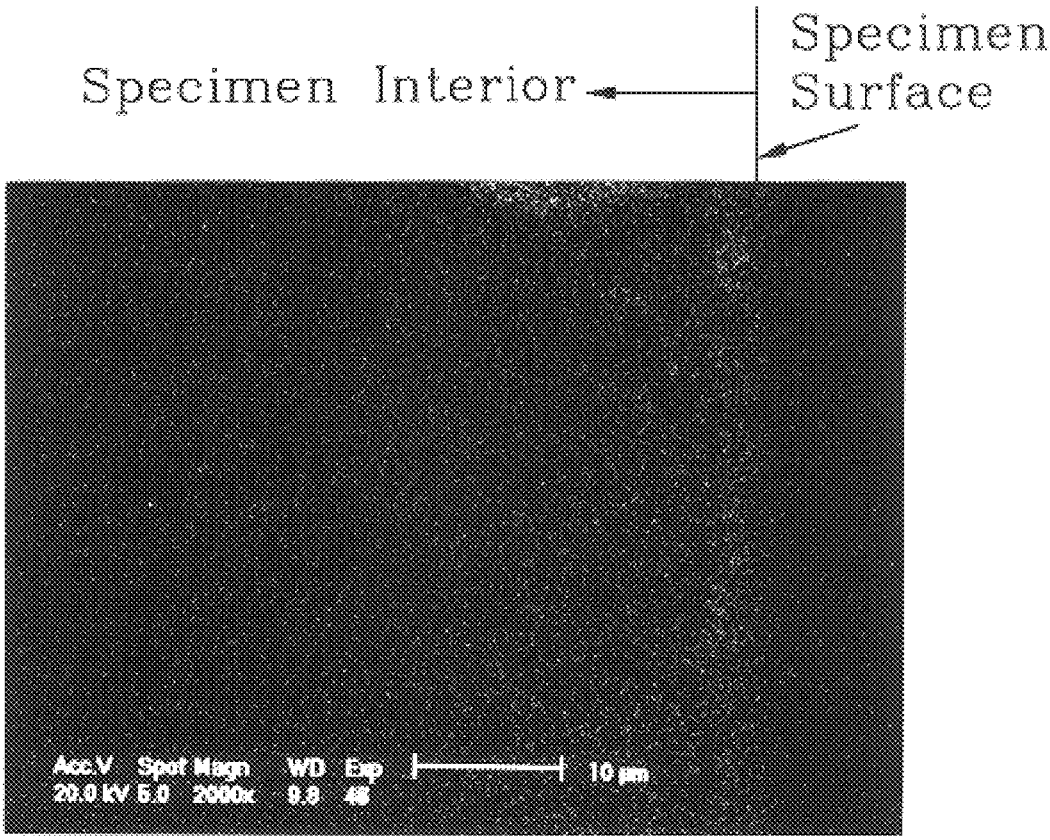
FIG. 6 is a photograph showing the distribution of elemental silicon in the cross section of the steel specimen.

The silicon content and the distribution of elemental silicon in the cross section of the steel obtained from example 4 are shown in FIG. 3 and 6. Referring to FIG. 3, the elemental silicon content decreases going from the surface to the core of the specimen. Thus, it is clear that the silicon content in the surface is higher than that in the core of the specimen. The silicon content in the surface of the specimen is as much as 3.3 wt % analyzed by EDS assay. In addition, referring to FIG. 6, the density of the white points is proportional to silicon content. Thus, it can be seen that the silicon-enriched zone is in the surface.

Figure 5:
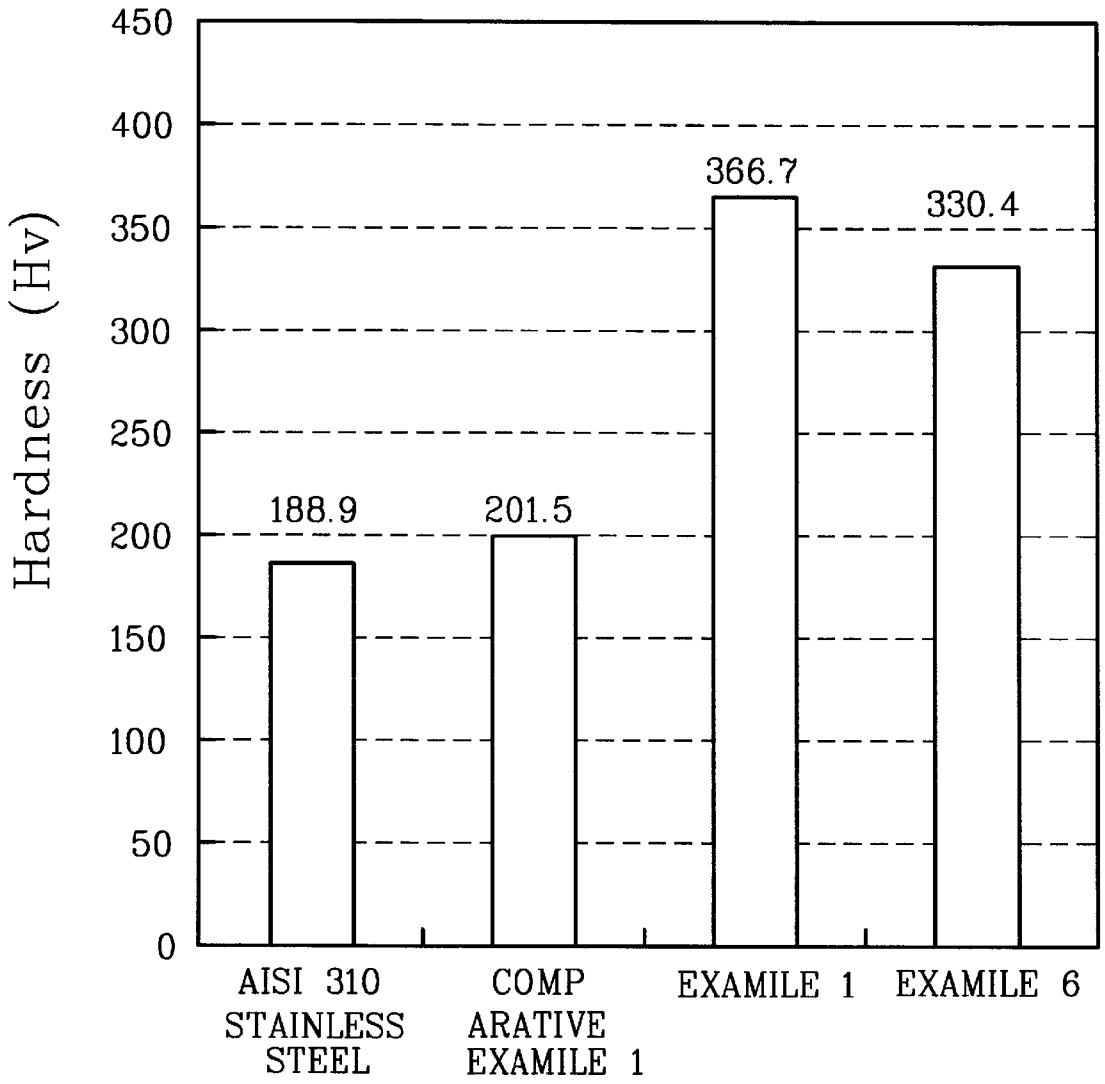
FIG. 5 shows the comparison of the hardness of various steel specimens.

The result of the hardness test of the specimen obtained from examples 1, 6 and comparative example 1 is shown in FIG. 5. The test reveals the surface hardness of the 3 specimens described above is higher than that of untreated AISI 301 steel. However, the hardness of the specimen obtained from comparative example 1 is much closer to that of untreated AISI 301 steel. This is because an inert atmosphere was not used in this example and thus the silicon content was not increased in the surface. From FIG. 5, it is also clear that the increase of silicon content elevates the hardness.

From the results obtained from the examples described above, the method according to the present invention can be used to effectively deposit silicon onto the surface of the specimen. Furthermore, the silicon content in the surface of the specimen treated by the method of the present invention is as much as 4.0 wt %. Treatment with higher temperature can obtain a thicker silicon deposition depth.

While the invention has been particularly shown and described with the reference to the preferred embodiment thereof, it will be understood by those skilled in the art that various changes in form and details may be made without departing from the spirit and scope of the invention.

What is claimed is:

1. A method for co-depositing silicon and nitrogen coatings on a stainless steel surface, comprising the steps of:

(a) cleaning the surface of said stainless steel;

(b) placing a cementation pack in surrounding relationship to the surface of said stainless steel, the cementation pack including at least a mixture of sodium fluoride, silica and silicon nitride powder; and (c) heating said cementation pack containing said stainless steel and said mixture in an inert atmosphere, wherein the silicon nitride powder is decomposed into elemental silicon and nitrogen and diffusely coated onto the surface of said stainless steel to form a nitrogen containing high silicon stainless steel.

2. The method as claimed in claim 1, wherein said stainless steel is selected from the group consisting of austenite, ferrite, martensite and dual-phase stainless steel.

3. The method as claimed in claim 1, wherein the amount of said silicon nitride ranges from 5 wt % to 80 wt % based on the total weight of the mixture.

4. The method as claimed in claim 1, wherein the amount of said sodium fluoride ranges from 5 wt % to 15 wt % based on the total weight of the mixture.

5. The method as claimed in claim 1, wherein the amount of said silica ranges from 5 wt % to 80 wt % based on the total weight of the mixture.

6. The method as claimed in claim 1, wherein the inert atmosphere in step (c) comprises nitrogen, argon or a reducing atmosphere.

7. The method as claimed in claim 1, wherein the heating temperature ranges from 700° C. to 1300° C. in step (c).

8. The method as claimed in claim 1, wherein the time of heating ranges from 1 minute to 100 hours.

9. The method as claimed in claim 1, wherein the nitrogen containing high silicon stainless steel is comprised of 1% to 15% silicon content and 0.1% to 0.6% nitrogen content.

10. The method as claimed in claim 1, wherein the thickness of the surface of coated stainless steel is between 1 and 100 $\mu$m.

11. The method as claimed in claim 1, wherein the cleaning process in step (a) comprises mechanical and/or physical and chemical means.

12. The method as claimed in claim 11, wherein the mechanical means comprises grinding the surface.

13. The method as claimed in claim 12, wherein the mechanical means comprises grinding the surface using silicon carbonate sandpaper.

14. The method as claimed in claim 11, wherein the physical and chemical means comprises ultrasonicating the surface in acetone solution.

* * * * *